US006389844B1

(12) United States Patent
Klein Nagel Voort

(10) Patent No.: US 6,389,844 B1
(45) Date of Patent: May 21, 2002

(54) PLANT FOR LIQUEFYING NATURAL GAS

(75) Inventor: Robert Klein Nagel Voort, The Hague (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/856,011

(22) PCT Filed: Nov. 16, 1999

(86) PCT No.: PCT/EP99/09113

§ 371 Date: May 16, 2001

§ 102(e) Date: May 16, 2001

(87) PCT Pub. No.: WO00/29797

PCT Pub. Date: May 25, 2000

(30) Foreign Application Priority Data

Nov. 18, 1998 (EP) ..... 98309451

(51) Int. Cl.[7] ..... F25J 1/00; F25J 3/00

(52) U.S. Cl. ..... 62/612; 62/619

(58) Field of Search ..... 62/612, 613, 614, 62/611, 615, 335, 912

(56) References Cited

U.S. PATENT DOCUMENTS

| | | | | |
|---|---|---|---|---|
| 4,680,041 A | * | 7/1987 | DeLong | 62/612 |
| 5,473,900 A | * | 12/1995 | Low | 62/335 |
| 6,253,574 B1 | * | 7/2001 | Stockmann et al. | 62/612 |

FOREIGN PATENT DOCUMENTS

| | | | |
|---|---|---|---|
| EP | 0 142 899 A | 5/1985 | F25J/1/02 |
| WO | 94 24500 A | 10/1994 | F25J/1/02 |
| WO | 96 33379 A | 10/1996 | F25J/1/02 |
| WO | 97 33131 | 9/1997 | F25J/1/02 |

* cited by examiner

*Primary Examiner*—William C. Doerrler

(57) ABSTRACT

Plant for liquefying natural gas comprising one pre-cooling heat exchanger (2) having an inlet (13) for natural gas and an outlet (14) for cooled natural gas, a pre-cooling refrigerant circuit (3), one distributor (4) having an inlet (18) connected to the outlet (14) for cooled natural gas and having two outlets (22, 23), two main heat exchangers (5, 5'), and two main refrigerant circuits (9, 9') each co-operating with one liquefaction heat exchanger (5, 5').

4 Claims, 2 Drawing Sheets

PLANT FOR LIQUEFYING NATURAL GAS

FIELD OF THE INVENTION

The present invention relates to a plant for liquefying natural gas. More specifically, a pre-cooled, dual heat exchanger, dual refrigerant system. Such a plant comprises a natural gas pre-cooling heat exchanger having an inlet for natural gas and an outlet for cooled natural gas and a liquefaction heat exchanger comprising a first hot side having an inlet connected to one outlet for cooled natural gas and an outlet at the top of the liquefaction heat exchanger for liquefied natural gas. The plant further comprises a pre-cooling refrigerant circuit for removing heat from the natural gas in the natural gas pre-cooling heat exchanger, and a liquefaction (or main) refrigerant circuit for removing heat from natural gas flowing through the first hot side of the main heat exchanger. Such a plant is for example known from International patent applications publication No. 96/33 379 and publication No. 97/33 131. The latter publication further discloses that the compressors in the pre-cooling refrigerant circuit and in the liquefaction refrigerant circuit are mechanically interconnected.

BACKGROUND OF THE INVENTION

During normal operation, the natural gas to be liquefied is pre-cooled in the hot side of the natural gas pre-cooling heat exchanger by heat exchange with refrigerant evaporating in the cold side. Evaporated refrigerant is removed from the cold side of the heat exchanger. This evaporated refrigerant is liquefied in the pre-cooling refrigerant circuit. To this end the refrigerant is compressed in a compressor to an elevated pressure, and the heat of compression and the heat of vaporization are removed in a condenser. The liquid refrigerant is allowed to expand in the expansion device to a lower pressure, and at this pressure the refrigerant is allowed to evaporate in the cold side of the natural gas pre-cooling heat exchanger.

The pre-cooled natural gas is subsequently further cooled, liquefied and sub-cooled to about its atmospheric boiling point in the first hot side of the liquefaction heat exchanger by heat exchange with refrigerant evaporating in the cold side of the main heat exchanger. Evaporated refrigerant is removed from the cold side of the liquefaction heat exchanger. This evaporated refrigerant is liquefied in the main refrigerant circuit. To this end the refrigerant is compressed in a compressor to an elevated pressure and the heat of compression is removed in a number of heat exchangers. The refrigerant is then condensed and separated into a light, gaseous fraction and a heavy, liquid fraction, which fractions are further cooled in separate hot sides in the liquefaction heat exchanger to obtain liquefied and sub-cooled fractions at elevated pressure. The sub-cooled refrigerants are then allowed to expand in expansion devices to a lower pressure, and at this pressure the refrigerant is allowed to evaporate in the cold side of the main heat exchanger.

This plant is usually called a single-train liquefaction plant. Such a plant is so designed that the maximum amount of gas that can be liquefied is practically limited by the maximum amount of power that can be delivered by the turbines driving the compressors in the pre-cooling and the main refrigerant circuit. In order that more natural gas can be liquefied a second train of the same size is built. A plant consisting of two such trains is called a double-train liquefaction plant. The double-train liquefaction plant, however, will have a liquefaction capacity that is twice the liquefaction capacity of the single-train liquefaction plant. Because such a large increase of liquefaction capacity is not always required, there is a need to get an increase in the liquefaction capacity of about 40 to about 60%.

SUMMARY OF THE INVENTION

This about 40 to 60% increase of liquefaction capacity can be achieved by turning down the production of the double-train liquefaction plant to the desired level. Alternatively this aim can be achieved with two smaller trains, each having a maximum capacity of about 70 to 80% of the larger train.

It is an object of the present invention to provide a plant for liquefying natural gas having a liquefaction capacity which is 40 to 60% higher than that of the larger liquefaction train, wherein the building expenses are less than the building expenses associated with a plant consisting of two smaller trains, each having a maximum capacity of about 70 to 80% of the larger train.

To this end the plant for liquefying natural gas according to the present invention comprises one natural gas pre-cooling heat exchanger having an inlet for natural gas and an outlet for cooled natural gas, a distributor having an inlet connected to the outlet for cooled natural gas and having at least two outlets, and at least two main heat exchangers each comprising a first hot side having one inlet connected to one outlet of the distributor and an outlet for liquefied natural gas, which plant further comprises a pre-cooling refrigerant circuit for removing heat from the natural gas in the natural gas pre-cooling heat exchanger, and at least two main refrigerant circuits for removing heat from natural gas flowing through the first hot side of the corresponding main heat exchanger, wherein the pre-cooling refrigerant circuit further comprises at least two additional circuits for removing heat from the main refrigerants in each of the main refrigerant circuits.

The invention will now be described by way of example in more detail with reference to the accompanying drawings, wherein

DETAILED DESCRIPTION OF THE FIGURES

Figure 1:
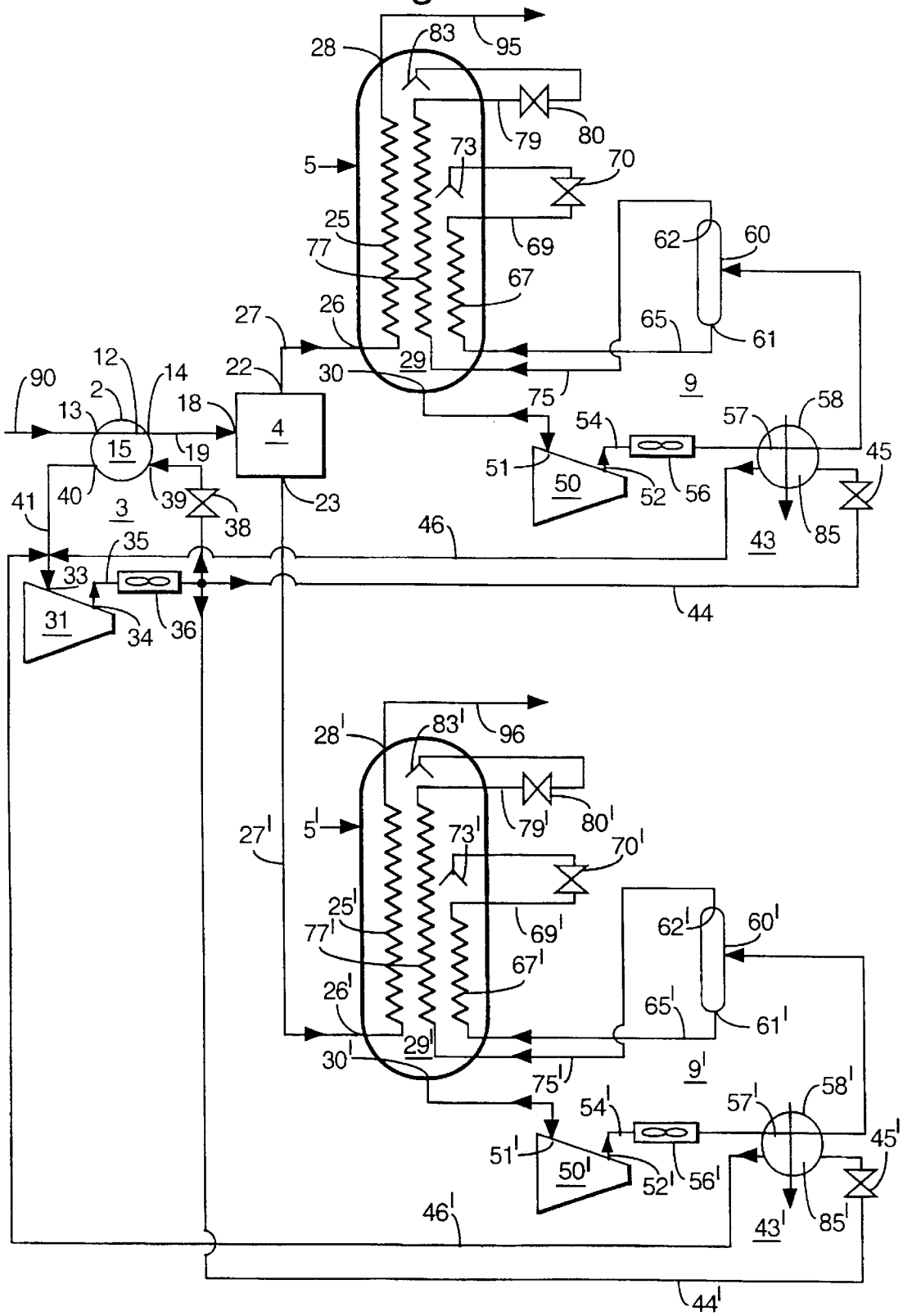
FIG. 1 shows schematically the liquefaction plant according to the present invention.

Reference is made to FIG. 1. The plant for liquefying natural gas according to the present invention comprises one natural gas pre-cooling heat exchanger 2, a pre-cooling refrigerant circuit 3, a distributor 4, two main heat exchangers 5 and 5', and two main refrigerant circuits 9 and 9'.

The natural gas pre-cooling heat exchanger 2 has a hot side in the form of tube 12 that has an inlet 13 for natural gas and an outlet 14 for cooled natural gas. The tube 12 is arranged in the cold side or shell side 15 of the natural gas pre-cooling heat exchanger 2.

The distributor 4 has an inlet 18 connected by means of conduit 19 to the outlet 14 for cooled natural gas and two outlets 22 and 23.

Each liquefaction heat exchanger 5, 5' comprises a first hot side 25, 25' having one inlet 26, 26'. The inlet 26 of the first hot side 25 is connected to the outlet 22 of the distributor 4 and the inlet 26' of the first hot side 25' is connected to the outlet 23, by means of conduits 27 and 27', respectively. Each first hot side 25, 25' has an outlet 28, 28' at the top of the liquefaction heat exchanger 5, 5' for liquefied natural gas. The first hot side 25, 25' is located in the cold side 29, 29' of the liquefaction heat exchanger 5, 5', which cold side 29, 29' has an outlet 30, 30'.

The pre-cooling refrigerant circuit 3 comprises a turbine-driven pre-cooling refrigerant compressor 31 having an inlet 33 and an outlet 34. The outlet 34 is connected by means of conduit 35 to a cooler 36, which may be an air cooler or a water cooler. Conduit 35 extends via an expansion device in the form of a throttle 38 to the inlet 39 of the cold side 15 of the natural gas pre-cooling heat exchanger 2. The outlet 40 of the cold side 15 is connected by means of return conduit 41 to the inlet 33 of the turbine-driven pre-cooling refrigerant compressor 31.

The pre-cooling refrigerant circuit 3 does not only pre-cool the natural gas, it also serves to pre-cool the refrigerant in the main refrigerant circuits 9 and 9'. To this end, the pre-cooling circuit 3 comprises additional circuits 43 and 43'. Each additional circuit 43, 43' comprises a conduit 44, 44' including an expansion device in the form of throttle 45, 45' and a return conduit 46, 46'.

Each liquefaction refrigerant circuit 9, 9' comprises a gas turbine-driven liquefaction refrigerant compressor 50, 50' having an inlet 51, 51' and an outlet 52, 52'. The inlet 51, 51' is connected by means of return conduit 53, 53' to the outlet 30, 30' of the cold side 29, 29' of the liquefaction heat exchanger 5, 5'. The outlet 52, 52' is connected by means of conduit 54, 54' to a cooler 56, 56', which may be an air cooler or a water cooler, and the hot side 57, 57' of a refrigerant heat exchanger 58, 58' to a separator 60, 60'. Each separator 60 has an outlet 61, 61' for liquid at its lower end and an outlet 62, 62' for gas at its upper end.

Each liquefaction refrigerant circuit 9, 9' further includes a first conduit 65, 65' extending from the outlet 61, 61' to the inlet of a second hot side 67, 67' that extends to a mid point of the liquefaction heat exchanger 5, 5', a conduit 69, 69', an expansion device 70, 70' and an injection nozzle 73, 73'.

Each liquefaction refrigerant circuit 9, 9' further includes a second conduit 75, 75' extending from the outlet 62, 62' to the inlet of a third hot side 77, 77' that extends to the top of the liquefaction heat exchanger 5, 5', a conduit 79, 79', an expansion device 80, 80' and an injection nozzle 83, 83'.

Each refrigerant heat exchanger 58, 58' includes a cold side 85, 85' that is included in the additional circuit 43, 43'.

Suitably the main refrigerant circuits 9 and 9' are identical to each other and so are the main heat exchangers 5 and 5'.

During normal operation, natural gas is supplied to the inlet 13 of the hot side 14 of the natural gas pre-cooling heat exchanger 2 through conduit 90. Pre-cooling refrigerant is removed from the outlet 40 of the cold 15 of the natural gas pre-cooling heat exchanger 2, compressed in the turbine-driven pre-cooling refrigerant compressor 31 to an elevated pressure, condensed in the condenser 36 and allowed to expand in the expansion device 38 to a low pressure. In the cold side 15 the expanded pre-cooling refrigerant is allowed to evaporate at the low pressure and in this way heat is removed from the natural gas.

Pre-cooled natural gas removed from the hot side 14 is passed to the distributor 4 through conduit 19.

Through conduits 27 and 27' the pre-cooled natural gas is supplied to the inlets 26 and 26' of the first hot sides 25 and 25' of the main heat exchangers 5 and 5'. In the first hot side 25, 25' the natural gas is liquefied and sub-cooled. Sub-cooled natural gas is removed through conduits 95 and 96. The amounts of natural gas passing through conduits 27 and 27' are suitably equal to each other. The sub-cooled natural gas is passed to a unit for further treating (not shown) and to tanks for storing the liquefied natural gas (not shown).

Main refrigerant is removed from the outlet 30, 30' of the cold side 29, 29' of the liquefaction heat exchanger 5, 5', compressed to an elevated pressure in the gas turbine-driven liquefaction refrigerant compressor 50, 50'. The heat of compression is removed in cooler 56, 56' and further heat is removed from the main refrigerant in the refrigerant heat exchanger 58, 58' to obtain partly condensed refrigerant. Partly condensed main refrigerant is then separated in separator 60, 60' into a heavy, liquid fraction and a light, gaseous fraction, which fractions are further cooled in the second and the third hot side 67, 67' and 77, 77' respectively to obtain liquefied and sub-cooled fractions at elevated pressure. The sub-cooled refrigerants are then allowed to expand in expansion devices 70, 70' and 80, 80' to a lower pressure. At this pressure the refrigerant is allowed to evaporate in the cold side 29, 29' of the liquefaction heat exchanger 5, 5' to remove heat from the natural gas passing through the first cold side 25, 25'.

In the above described embodiment, the pre-cooling refrigerant is suitably a single component refrigerant, such as propane, or a mixture of hydrocarbon components or another suitable refrigerant used in a compression cooling cycle or in an absorption cooling cycle. The main refrigerant is suitably a multi-component refrigerant comprising nitrogen, methane, ethane, propane and butane.

The natural gas pre-cooling heat exchanger 2 comprises suitably a set of two or more heat exchangers arranged in series, wherein pre-cooling refrigerant is allowed to evaporate at one or more pressure levels. Suitably, the refrigerant heat exchangers 58 and 58' comprise a set of two or more heat exchangers arranged in series, wherein the pre-cooling refrigerant is allowed to evaporate at one or more pressure levels.

Figure 2:
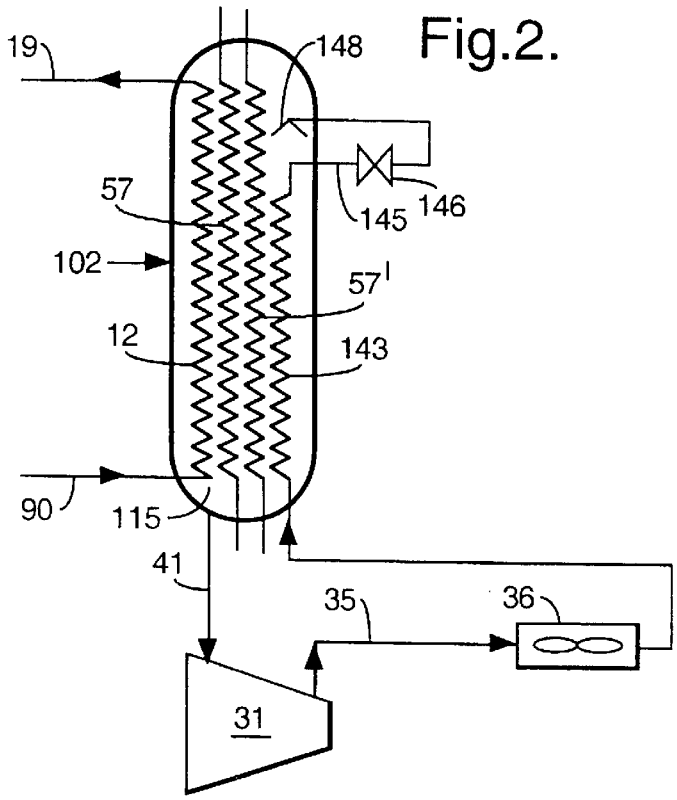
FIG. 2 shows schematically an alternative of the pre-cooling refrigerant circuit shown in FIG. 1.

Reference is now made to FIG. 2, which shows schematically an alternative of the pre-cooling refrigerant circuit 3 and additional circuits 43 and 43' as shown in FIG. 1. The natural gas pre-cooling heat exchanger 2 and the refrigerant heat exchangers 58 and 58' shown in FIG. 1 are combined in one integrated heat exchanger 102. The integrated heat exchanger 102 has a cold side 115 in which are arranged the hot side 12 through which during normal operation the natural gas flows, and the hot sides 57 and 57' pertaining to the main refrigerant circuits 9 and 9' , respectively. In this embodiment, the pre-cooling refrigerant is suitably a multi-component refrigerant comprising nitrogen, methane, ethane, propane and butane. During normal operation, evaporated pre-cooling refrigerant is removed from the cold side 115 through conduit 41, compressed to an elevated pressure by the pre-cooling refrigerant compressor 31, cooled in cooler 36 and supplied to additional hot side 143 arranged in the cold side of the integrated heat exchanger 102. In the additional hot side 143, the pre-cooling refrigerant is liquefied against evaporating refrigerant. The liquefied pre-cooling refrigerant is removed from the additional hot side 143 through conduit 145 provided with expansion device in the form of throttle 146, where it is allowed to expand to a lower pressure. At this lower pressure the refrigerant is supplied through injection nozzle 148 into the cold side 115.

Figure 3:
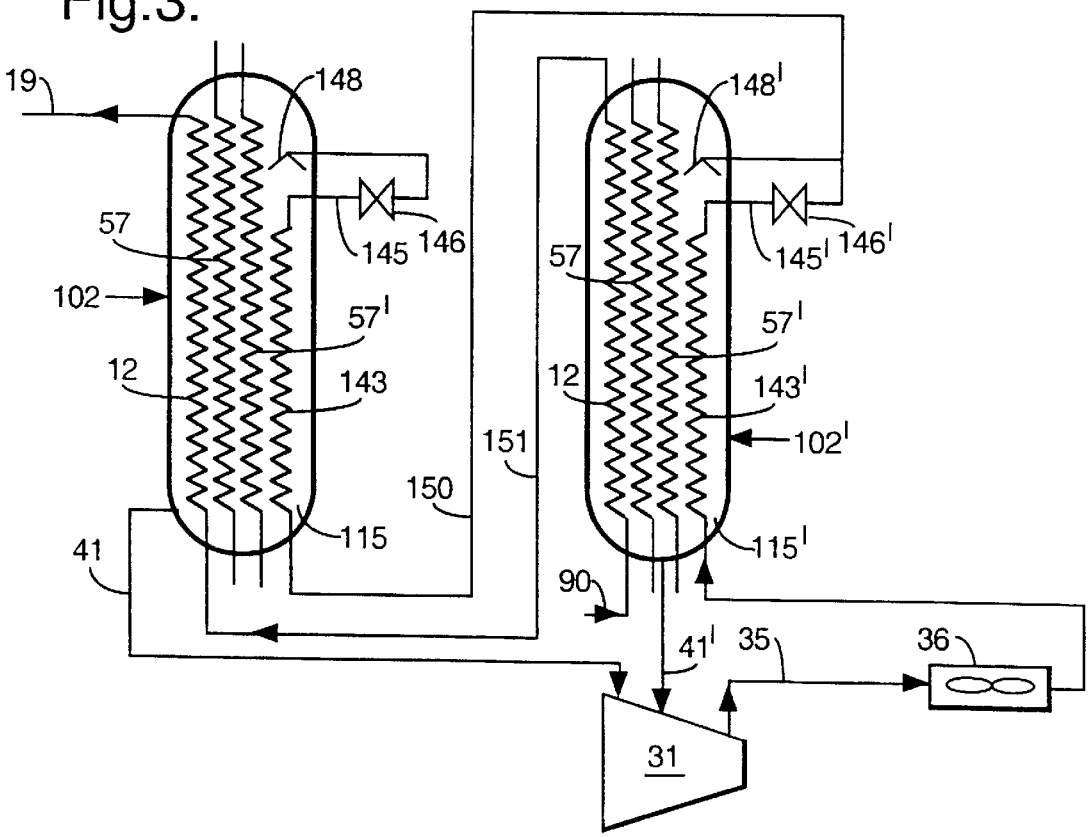
FIG. 3 shows schematically an alternative of the embodiment of FIG. 2.

Reference is made to FIG. 3 showing an alternative of the embodiment of FIG. 2, wherein the pre-cooling refrigerant compressor 31 is a two-stage compressor. The two-stage compressor 31 supplies refrigerant at elevated pressure to the additional hot side 143' of the first stage integrated pre-cooling heat exchanger 102', wherein part of the refrigerant is allowed to evaporate at intermediate pressure in the cold side 115'. The remainder is passed through conduit 150 to the additional hot side 143 of the second stage integrated pre-cooling heat exchanger 102, this refrigerant is allowed to evaporate at low pressure in the cold side 115. In the first and second stage heat exchangers 102 and 102' the natural gas is pre-cooled, wherein the hot sides 12 are interconnected by means of conduit 151, and the liquefaction refrigerant of each of the liquefaction refrigerant circuits is pre-cooled in hot sides 57 and 57'. For the sake of clarity the conduits interconnecting the latter hot sides have not been shown.

Instead of two stages, the integrated pre-cooling heat exchanger may comprise three stages in series.

The main heat exchangers 5 and 5' can be of any suitable design, such as a spoolwound heat exchanger or a plate-fin heat exchanger.

In the embodiment as described with reference to FIG. 1, the liquefaction heat exchanger 5, 5' has a second and a third hot side, 67, 67' and 77, 77', respectively. In an alternative embodiment, the liquefaction heat exchanger has only one hot side in which the second and the third hot side are combined. In this case the partly condensed main refrigerant is directly supplied to the third hot side 77, 77', without separating it into a heavy, liquid fraction and a light, gaseous fraction.

The compressors 31, 50 and 50' can be multi-stage compressors with inter-cooling, or a combination of compressors in series with inter-cooling in between two compressors, or a combination of compressors in parallel.

Instead of turbines, electric motors can be used to drive the compressors 31, 50 and 50' in the pre-cooling refrigerant circuit 3 and the two main refrigerant circuits 9 and 9'.

Suitably the turbine (not shown) in the pre-cooling refrigerant circuit is a steam turbine. In this case suitably, the steam required to drive the steam turbine is generated with heat released from cooling the exhaust of the gas turbines (not shown) of the main refrigerant circuits.

The present invention provides an expandable plant for liquefying natural gas, wherein in a first stage a single train is build with a 100% liquefaction capacity, and wherein in a second stage the second liquefaction heat exchanger and the second liquefaction refrigerant circuit of the same size as the first ones can be added to expand the liquefaction capacity to between about 140 and about 160%.

The pre-cooling refrigerant circuit now serves two main refrigerant circuits. Consequently the depth to which the natural gas is pre-cooled may be reduced. However, an advantage of the present invention is that the conditions of pre-cooling and liquefaction, for example the compositions of the refrigerant, can easily be adapted such that an efficient operation is achieved. Moreover, in case one of the liquefaction circuits has to be taken out of operation, the conditions can be adapted to work efficiently with a single liquefaction train.

In this way the liquefaction capacity can be increased without having to add a second pre-cooling circuit, and this saves substantial costs.

Calculations have furthermore shown that the liquefaction efficiency (amount of liquefied gas produced per unit of work done by the compressors) is not adversely affected by using a pre-cooling refrigerant circuit serving two main refrigerant circuits.

What is claimed is:

1. Plant for liquefying natural gas comprising one pre-cooling heat exchanger (2) having an inlet (13) for natural gas and an outlet (14) for cooled natural gas, a distributor (4) having an inlet (18) connected to the outlet (14) for cooled natural gas and having at least two outlets (22, 23), and at least two main heat exchangers (5, 5') each comprising a first hot side (25, 25') having one inlet (26, 26') connected to one outlet (22, 23) of the distributor (4) and an outlet (28, 28') for liquefied natural gas, which plant further comprises a pre-cooling refrigerant circuit (3) for removing heat from the natural gas in the pre-cooling heat exchanger (2), and at least two main refrigerant circuits (9, 9') for removing heat from natural gas flowing through the first hot side (25, 25') of the corresponding main heat exchanger (5, 5'), wherein the pre-cooling refrigerant circuit (3) further comprises at least two additional circuits (43, 43') for removing heat from the main refrigerants in each of the main refrigerant circuits (9, 9').

2. Plant for liquefying natural gas according to claim 1, wherein the refrigerant circuits (3, 9, 9') include a compressor (31, 50, 50') driven by a suitable driver.

3. Plant for liquefying natural gas according to claim 2, wherein the driver of the compressor (31) in the pre-cooling refrigerant circuit (3) is a steam turbine.

4. Plant for liquefying natural gas according to claim 3, wherein the drivers of the compressors (50, 50') in each of the liquefaction refrigerant circuits (9, 9') are gas turbines, and wherein, during normal operation, the steam required to drive the steam turbine is generated with heat released from cooling the exhaust of the gas turbines of the main refrigerant circuits (9, 9').

* * * * *